United States Patent [19]

Terry et al.

[11] 4,035,180

[45] July 12, 1977

[54] CATALYTIC PROCESS FOR THE REDUCTION OF ALUMINUM CHLORIDE BY MANGANESE

[75] Inventors: John Christopher Terry; Roger Frank Sebenik, both of Metairie; Ronald Wyndham, New Orleans, all of La.

[73] Assignee: Toth Aluminum Corporation, New Orleans, La.

[21] Appl. No.: 667,384

[22] Filed: Mar. 16, 1976

[51] Int. Cl.[2] ..... C22B 21/02

[52] U.S. Cl. ..... 75/68 R; 75/135; 75/138; 75/147

[58] Field of Search ..... 75/68 B, 68 R, 138, 75/147, 135

[56] References Cited

U.S. PATENT DOCUMENTS

| | | | |
|---|---|---|---|
| 3,078,159 | 2/1963 | Hollingshead et al. | 75/68 B X |
| 3,137,567 | 6/1964 | McGeer | 75/68 B X |
| 3,615,359 | 10/1971 | Toth | 75/68 R |
| 3,615,360 | 10/1971 | Harris et al. | 75/68 R |
| 3,677,742 | 7/1972 | Toth | 75/68 B |
| 3,713,809 | 1/1973 | Toth et al. | 75/68 B |
| 3,713,811 | 1/1973 | Toth et al. | 75/68 R |
| 3,900,312 | 8/1975 | Terry et al. | 75/68 B |
| 3,918,960 | 11/1975 | Toth | 75/68 B |

*Primary Examiner*—G. Ozaki
*Assistant Examiner*—E. L. Weise

[57] ABSTRACT

The present invention provides a process for the catalytic reduction of aluminum chloride by manganese to form a high aluminum content alloy, separating the catalysis metal from the alloy, and separating the manganese in the alloy to produce essentially pure aluminum. As a preferred embodiment, liquid aluminum chloride is contacted with solid manganese metal in the presence of a Group IIB metal or compound thereof at a relatively low temperature and at a pressure to maintain the reactants in such phases.

16 Claims, No Drawings

CATALYTIC PROCESS FOR THE REDUCTION OF ALUMINUM CHLORIDE BY MANGANESE

BACKGROUND OF THE PRESENT INVENTION

As disclosed in U.S. Pat. No. 3,900,312, the prior art teaches the reaction of aluminum chloride with manganese metal to produce elemental aluminum, that specific patent being concerned with the reaction of liquid aluminum chloride with solid manganese metal.

The application of that and related technology as disclosed therein is adopted herein by reference. By way of the present process, it has been observed that the presence of a Group II B metal as a catalyst in the reaction of aluminum chloride with manganese results in, inter alia, greater reaction rates, greater yields, and allows lower operating temperatures for the production of alloys containing aluminum and manganese. These and other observed advantages and features of the present invention will come to light as the discussion proceeds.

The primary object of the present invention is to catalytically reduce liquid aluminum chloride with solid powdered manganese in the presence of a Group II B metal or compound thereof to produce aluminum containing alloys.

It is another object of the present invention to produce aluminum-manganese alloys by separating the catalyst metal from the initial reaction product alloy.

A still further important object of the present invention is the production of essentially pure aluminum metal by separating the catalyst metal, manganese metal, and other impurities from the initial reaction product alloy.

These and other important objects and advantages of the present invention will be more apparent in light of the following description and appended claims.

SUMMARY

The present process basically comprises reacting aluminum chloride with manganese in the presence of a Group II B metal or compounds thereof to produce a high content aluminum alloy. It is preferred to react the aluminum chloride in a liquid phase with the manganese in the solid phase. The process is preferably conducted at a temperature less than about 350° C and at a pressure less than about 450 psia under various conditions within those parameters to maintain the respective reactants in the desired phases. A particularly preferred catalyst is a Group IIB Metal selected from the group consisting of zinc, cadmium or mercury, especially the latter from a technological viewpoint, however, zinc is preferred from an economical viewpoint.

An especially preferred embodiment of the present process comprises the additional steps of separating the catalysis metal and also the manganese metal from the resultant reaction alloy to produce essentially pure aluminum.

DESCRIPTION OF THE PREFERRED EMBODIMENTS

The process of the present invention comprises the reduction of liquid aluminum chloride by solid powdered manganese in the presence of a Group II B metal or compound thereof to produce an aluminum containing alloy product. The reduction reaction can be carried out in the temperature range of 200° C to 350° C and at pressures of about 30 atmospheres or less. The temperature and pressure are not critical so long as they are adequate to maintain the reactants in the desired phases. Temperatures less than about 200° C and higher than 350° C are possible by adding inert salts to the aluminum chloride thus lowering the aluminum chloride melting point and also lowering the aluminum chloride vapor pressure.

The reduction of liquid aluminum chloride by powdered manganese is operable under the present conditions without the addition of catalysts, but the reaction rate is much slower. However, upon the addition of small amounts of a Group IIB metal or compound thereof the reaction rate is dramatically improved. Depending on such conditions as temperature, the addition of a Group II B metal catalyst can increase the reaction rate by a factor of five or more. The optimum amount of the catalyst needed in order to achieve these improved reaction rates will vary depending on the specific catalyst and certain other conditions, but generally will be in the order of about 0.5% by weight of aluminum chloride.

The mechanism by which the Group IIB metals and compounds thereof act as catalysts for the reduction of aluminum chloride by manganese is not well established. It has been observed, however, that the aluminum reaction product alloy contains or is comingled with Group IIB metals regardless of whether the catalyst was added in metallic form as a compound. Since the Group II B metal compounds are either directly or indirectly reducible to the metallic state by both aluminum and manganese it is believed that the catalyst compounds are first reduced to the metallic state and form a surface film on the manganese particles in the form of a liquid or low melting alloy or pure metal. Since the Group II B metals all have relatively low melting points near or below the temperature range for the process of the present invention, it is speculated that the metals are acting as liquid or semi-fluid catalytic surface coatings on the manganese particles. Therefore, consistant with this theory, the term catalyst is meant to include not only the active form of the catalyst, but also other chemical forms and compounds which are capable of generating the active form of the catalyst. As further evidence to support the above theory it has been found that mercury is a more efficient catalyst at temperatures below 300° C than is zinc where mercury is a liquid, but zinc is clearly a solid. Above about 300° C mercury is still an efficient catalyst, but it has been observed that zinc also becomes an efficient catalyst with increasing temperature. In any event and not being limited by theory, the use of mercury and compound thereof give excellent increases in reaction rates in the temperature range of about 200° to 350° C or higher and cadmium and zinc metals and compounds thereof give excellant results at temperatures of about 300° C and higher.

The aluminum chloride, manganese, and catalysts used in the process of the present invention should be relatively pure since any metallic impurities reducible by manganese or aluminum could result in decreasing the effectiveness of the catalyst and also contamination of the product alloys. For example, iron chlorides are common impurities in aluminum chloride and as such would be readily reduced to iron metal by manganese and thus contaminate the product. The limits of impurities in the reactants will depend on the specific nature of those impurities, the proportions of the reactants being used, and other considerations.

Generally the reaction of aluminum chloride with manganese will be carried out using excess aluminum chloride to maintain the reaction mixture in the form of a slurry. Practicing the process of the present invention in this manner provides for ease of moving, stirring, and otherwise handling the reaction mixture and additionally provides for the separation of the manganese chloride product from the alloy product by dissolving the manganese chloride in the excess aluminum chloride. The manganese chloride can then be readily separated from the aluminum chloride in another step of the process by selective vaporization, fractional distillation, fractional crystallization, or any other suitable means. Similarly, the solid alloy product can be separated from the excess aluminum chloride-manganese chloride solution by filtration, settling, or other suitable means.

After the reaction of aluminum chloride with manganese has been carried to the desired extent of completion and the solid alloy product separated from the liquid salts, the alloy is further processed to remove the catalyst metal. Depending on specifically which Group II B metal was utilized and whether or not the catalyst metal is co-mingled or alloyed with the aluminum-manganese product will determine the best method of separation. Generally, the Group II B metals have much lower boiling points, higher specific gravities, and lower melting points than aluminum-manganese alloys and thus numerous methods for separating the Group II B metals would be available, such as floatation, selective melting, vaporization, freeze purification, etc. After separation of the Group II B metal from the product alloy, the catalyst can then be recycled as such for further utilization or can be first converted into a compound form before reuse. Obviously, it would be economically more attractive to recycle the catalyst in the metallic form since the use of the catalyst as the chloride for example, would consume aluminum and/or manganese during the reduction reaction and further would require rechlorination of the thus separated catalyst metal.

The aluminum-manganese alloy resulting from the separation of the catalyst metal from the initial reaction product alloy can be further refined to produce essentially pure aluminum. Potential methods for separating the Al and Mn are aluminum subhalide distillation, preferential alloy formation, zone freezing, or differential vaporization. After separation, the manganese is recycled for further reaction and utilization. Depending on the specific method used for separating the manganese, it may be desirable or necessary to regrind the manganese into powder form.

EXAMPLE 1–9

In the following examples, Group II B metals and compounds were employed as catalysts to illustrate the variety of chemical forms of the Group II B metals that are operable in the process of the present invention. The tests were typically carried out in bomb reactors constructed of one inch O.D. by 6 inch long stainless steel pipes closed on both ends by pipe caps. The $AlCl_3$, Mn, and catalysts, all as reagent grade fine powders, were weighed out and placed into the bomb reactors under an inert atmosphere in a glove box. A kiln furnace with a rotating bomb holder was used to heat and agitate the bomb reactors. Rotation speed was 60 r.p.m. in all tests. After the reaction was completed the furnace was shut off and the bomb reactors were cooled to facilitate handling. Removal of the reaction products from the bomb reactor and separation of the metals from the salts were accomplished by hot filtration through a sintered metal filter disc of 10 micron porosity where $AlCl_3$ vapor pressure in the heated bomb was used to force the salts through the filter. After filtration, any residual salts in the filtered product metals was removed by extraction in butanol and then methanol. The salt free metals were dissolved in hydrochloric acid and were analyzed by atomic absorption methods.

In examples 1–9, the $AlCl_3$ and Mn were mixed together in a 15 to 1 weight ratio, respectively, and the reactions were carried out for 15 hours at 240° C to 340° C. The catalysts shown were added to the reaction mixture in the form of metals, metal oxides, and metal chlorides and in amounts ranging from zero to 1.5% by weight of the $AlCl_3$ charged. The reaction conditions for examples 1–9 are summarized in Table I along with the test results which are expressed as the percent of Mn reacted to form Al metal and as the percent of Al in the resulting Al–Mn product alloy. As discussed above, the Group II B metal compounds react with Al and/or Mn metal to form the Group II B metal. Thus, the addition of either a metallic or compound form of the catalyst metals results in the Al–Mn product being comingled or alloyed with the catalyst metal. Therefore, to more clearly illustrate the effect of the Group II B metal catalysts, the catalyst and trace metal impurities such as iron have been subtracted and the product composition given on an aluminum and manganese basis.

Referring to Table I, it can be seen that in examples 1–8 to which a catalyst was added, the reactions all resulted in greater than 70% reaction of the Mn to form aluminum with the metallic product containing from 47% to 69% Al on an Al plus Mn basis. In contrast example 9 contained no catalyst and resulted in only 39% reaction of the Mn to form Al and only about 18% Al in the product. It is therefore clear that a variety of Group II B metals and compounds can be used to catalyze the reaction of aluminum chloride with manganese and that the use of a Group II B metal catalyst results in about twice as much reaction of the Mn to form Al and about 3 and 4 times as much Al in the Al–Mn product compared to the reaction without any catalyst added.

TABLE I

| Example No. | Ratio $AlCl_3$:Mn | Temp. ° C | Time Hrs. | Group II B Catalyst | % Catalyst In $AlCl_3$ | % Mn Reacted to Form Al | % Al In Product Al-Mn Alloy |
|---|---|---|---|---|---|---|---|
| 1 | 15:1 | 340 | 15 | $ZnCl_2$ | 0.5 | 78.7 | 60.7 |
| 2 | 15:1 | 340 | 15 | ZnO | 1.1 | 83.5 | 62.8 |
| 3 | 15:1 | 340 | 15 | ZnO | 0.3 | 74.7 | 51.2 |
| 4 | 15:1 | 340 | 15 | $CdCl_2$ | 0.5 | 71.7 | 47.0 |
| 5 | 15:1 | 240 | 15 | $HgCl_2$ | 1.5 | 83.4 | 62.3 |
| 6 | 15:1 | 240 | 15 | HgCl | 0.5 | 87.1 | 68.9 |
| 7 | 15:1 | 240 | 15 | HgO | 0.4 | 74.7 | 49.2 |
| 8 | 15:1 | 240 | 15 | HgO | 0.5 | 75.3 | 49.9 |
| 9 | 15:1 | 340 | 15 | None | None | 39.1 | 17.6 |

EXAMPLES 10–26

TABLE II

| Example No. | Ratio $AlCl_3$:Mn | Temp. ° C | Time Hrs. | Group II B Catalyst | % Catalyst In $AlCl_3$ | % Mn Reacted to Form Al | % Al In Product Al-Mn Alloy |
|---|---|---|---|---|---|---|---|
| 10 | 15:1 | 340 | 15 | ZnO | 0.05 | 43.2 | 20.3 |
| 11 | 15:1 | 340 | 15 | ZnO | 0.25 | 76.1 | 51.1 |
| 12 | 15:1 | 340 | 15 | ZnO | 1.0 | 80.4 | 57.4 |
| 13 | 15:1 | 400 | 15 | ZnO | 12.6 | 81.6 | 59.4 |
| 14 | 15:1 | 340 | 15 | $ZnCl_2$ | 0.5 | 78.7 | 60.7 |
| 15 | 15:1 | 340 | 15 | $ZnCl_2$ | 1.0 | 72.6 | 53.9 |
| 16 | 15:1 | 340 | 15 | $ZnCl_2$ | 2.1 | 72.1 | 57.7 |
| 17 | 15:1 | 340 | 15 | $ZnCl_2$ | 3.3 | 64.6 | 61.8 |
| 18 | 15:1 | 340 | 15 | $ZnCl_2$ | 10.0 | 16.8 | 62.3 |
| 19 | 15:1 | 250 | 16 | HgCl | 0.05 | 12.1 | 4.3 |
| 20 | 15:1 | 250 | 16 | HgCl | 0.1 | 17.3 | 6.4 |
| 21 | 15:1 | 250 | 16 | HgCl | 0.2 | 67.5 | 40.5 |
| 22 | 15:1 | 250 | 16 | HgCl | 0.4 | 78.4 | 54.3 |
| 23 | 15:1 | 250 | 16 | HgCl | 1.6 | 79.5 | 56.0 |
| 24 | 15:1 | 240 | 15 | $HgCl_2$ | 0.1 | 11.3 | 4.0 |
| 25 | 15:1 | 240 | 15 | $HgCl_2$ | 0.5 | 79.8 | 56.4 |
| 26 | 15:1 | 240 | 15 | $HgCl_2$ | 1.5 | 83.4 | 62.3 |

In the following examples were carried out using the same reactants and equipment described above for examples 1–9. The ratio of $AlCl_3$ to Mn was in all cases 15 to 1 by weight and the reaction time was 15 to 16 hours. The reaction temperature ranged from 240° to 340° C depending on the particular catalyst used and the amount of each catalyst was varied to illustrate the effect of catalyst concentration on the reaction. The conditions for the reaction and the test results are summarized in Table II.

In examples 10–13, zinc metal was added to the reaction as 0.05% to 12.6% by weight of the $AlCl_3$. The reaction with 0.05% ZnO added gave only slightly better results than example 9 in which no catalyst was added. Increasing the ZnO additive above 1.0% had little effect and thus the optimum level for adding ZnO as the catalyst is in the range of 0.25% to 1.0% by weight of the $AlCl_3$. In examples 14–18 $ZnCl_2$ was added as the catalyst as 0.5% to 10.0% by weight of the $AlCl_3$. Increasing the amount of $ZnCl_2$ added resulted in decreasing the amount of Mn reacted to form Al which was to be expected, but the % Al in the Al-Mn product remained essentially constant. Thus, the optimum level of $ZnCl_2$ catalyst is about 0.5% by weight of $AlCl_3$ or less.

In examples 19–23, HgCl was added as the catalyst as 0.05% to 1.6% by weight of $AlCl_3$. The addition of 0.05% HgCl in example 19 resulted in only 12.1% reaction of the Mn which is lower than that obtained in example 9 without any catalyst added, however, example 9 was at 340° C whereas example 19 was at only 250° C. Increasing the level of HgCl to 0.4% increases the amount of Mn reacted but further increases in HgCl gave only slight increases in the extent of Mn reacted. In examples 24–26, $HgCl_2$ was added as the catalyst as 0.1% to 1.5% by weight of $AlCl_3$. Again the lower levels of catalyst gave low reaction of Mn and levels above 0.5% gave only slight increases in reaction.

EXAMPLES 27–36

The following examples were carried out using the same reactants and equipment described above for examples 1–9. The $AlCl_3$ to Mn ratio was 15 to 1 by weight with 0.5% $ZnCl_2$ by weight of the $AlCl_3$ as the catalyst. The reactions were conducted at 250° to 300° C for 24 to 96 hours reaction time. The conditions for each example reaction along with the test results are summarized in Table III.

Examples 27–29 had a reaction temperature of 250° C and show increasing reaction of Mn to form Al with increasing reaction time, however, with only 29.1% reaction of the Mn after 96 hours. Similarly, examples 30–32 at 275° C show increasing reaction with increasing time with 62.5% of the Mn reacted after 96 hours. Conversely, examples 33–35 at 300° C showed only a slight increase in the Mn reacted between 24 and 96 hours, and resulted in 76.2% reaction after 24 hours. By contrast, examples 36 had 86.1% of the Mn reacted to form Al after only 3 hours at 325° C and with a 5 to 1 ratio of $AlCl_3$ to Mn. Thus it is clear that when using $ZnCl_2$ as the catalyst there is a significant positive effect of temperature on reaction rate and that at temperatures of about 325° C and higher the reaction rate is quite fast.

TABLE III

| Example No. | Ratio $AlCl_3$:Mn | Temp. ° C | Time Hrs. | Group II B Catalyst | % Catalyst In $AlCl_3$ | % Mn Reacted to Form Al | % Al In Product Al-Mn Alloy |
|---|---|---|---|---|---|---|---|
| 27 | 15:1 | 250 | 24 | $ZnCl_2$ | 0.5 | 19.6 | 7.4 |
| 28 | 15:1 | 250 | 48 | $ZnCl_2$ | 0.5 | 23.6 | 9.2 |
| 29 | 15:1 | 250 | 96 | $ZnCl_2$ | 0.5 | 29.1 | 11.8 |
| 30 | 15:1 | 275 | 24 | $ZnCl_2$ | 0.5 | 32.5 | 13.6 |
| 31 | 15:1 | 275 | 48 | $ZnCl_2$ | 0.5 | 50.5 | 25.1 |
| 32 | 15:1 | 275 | 96 | $ZnCl_2$ | 0.5 | 62.5 | 35.1 |
| 33 | 15:1 | 300 | 24 | $ZnCl_2$ | 0.5 | 76.2 | 51.2 |
| 34 | 15:1 | 300 | 48 | $ZnCl_2$ | 0.5 | 78.3 | 54.1 |
| 35 | 15:1 | 300 | 96 | $ZnCl_2$ | 0.5 | 78.9 | 55.2 |
| 36 | 15:1 | 325 | 3 | $ZnCl_2$ | 0.5 | 86.1 | 67.3 |

EXAMPLES 37–39

The following examples were carried out as described above and at 250° C using an 8 to 1 weight ratio of $AlCl_3$ to Mn. HgCl was added to the reaction mixtures as the catalyst as 1.3% by weight of the $AlCl_3$ and the reaction time was varied between 2 and 8 hours. Comparing examples 37–39 it can be seen that there is essentially no difference in the percent of Mn reacted to form Al or percent of Al in the product Al–Mn alloy after two hours reaction time. Thus, the reaction using HgCl as the catalyst is complete in 2 hours or less at 250° C and is much faster at lower temperatures than equivalent reactions using $ZnCl_2$ as the catalyst. The reaction conditions and results of examples 37–39 are summarized in Table IV.

TABLE IV

| Example No. | Ratio $AlCl_3$:Mn | Temp. ° C | Time Hrs. | Group II B Catalyst | % Catalyst In $AlCl_3$ | % Mn Reacted to Form Al | % Al In Product Al-Mn Alloy |
|---|---|---|---|---|---|---|---|
| 37 | 8:1 | 250° C | 2 | HgCl | 1.3 | 84.3 | 63.7 |
| 38 | 8:1 | 250° C | 4 | HgCl | 1.3 | 82.7 | 61.1 |
| 39 | 8:1 | 250° C | 8 | HgCl | 1.3 | 84.0 | 63.3 |

EXAMPLES 40–45

The following examples were carried out as described above. The reactions were run at 325° to 340° C for reaction times of 3 hours or greater and with 0.5% $ZnCl_2$ by weight of the $AlCl_3$ as the catalyst. The ratio of $AlCl_3$ to Mn was varied between 5 to 1 and 175 to 1 by weight and shows a significant increase in the percent of Al in the product Al–Mn alloy with increasing $AlCl_3$ to Mn ratio. The percent of Mn reacted to form Al did not increase proportionally, however, because increasing the $AlCl_3$ to Mn ratio also increases the amount of $ZnCl_2$ available for reaction with the Al and/or Mn thereby reducing the amount of Al produced. The data does clearly indicate, however, that an Al–Mn product alloy which is very high in Al can be produced using high $AlCl_3$ to Mn ratios. The test results of examples 40–45 are summarized in Table V.

TABLE V

| Example No. | Ratio $AlCl_3$:Mn | % Mn Reacted to Form Al | % Al in Product Al-Mn Alloy |
|---|---|---|---|
| 40 | 5:1 | 78.4 | 57.3 |
| 41 | 25:1 | 76.6 | 60.7 |
| 42 | 50:1 | 81.4 | 67.1 |
| 43 | 75:1 | 71.0 | 81.4 |
| 44 | 125:1 | 79.4 | 94.3 |
| 45 | 175:1 | 86.2 | 99.1 |

EXAMPLES 46–47

The following examples were carried as described above except that 20.5% KCl was added to the $AlCl_3$. The $AlCl_3$ and Mn were mixed in a 15 to 1 weight ratio and 0.4% $HgCl_2$ by weight of $AlCl_3$ was added as the catalyst. The reactions were carried out at 200° C for 3 hours and 27 hours resulting in 85.6 to 88.0% reaction of the Mn to form Al, thus illustrating the operability of the present invention at temperatures as low as 200° C and with an additive inert salt to lower the $AlCl_3$ vapor pressure. The reaction conditions and results of examples 46–47 are summarized in Table VI.

TABLE VI

| Example No. | Additive Salt | % Salt In $AlCl_3$ | Ratio $AlCl_3$:Mn | Temp. ° C | Time Hrs. | Group II B Catalyst | % Catalyst In $AlCl_3$ | % Mn Reacted to Form Al | % Al in Product Al-Mn Alloy |
|---|---|---|---|---|---|---|---|---|---|
| 46 | KCl | 20.5 | 15:1 | 200° C | 3 | $HgCl_2$ | 0.4 | 85.6 | 66.1 |
| 47 | KCl | 20.5 | 15:1 | 200° C | 27 | $HgCl_2$ | 0.4 | 88.0 | 70.6 |

The time required to drive the reaction to suitable yields pursuant to the present process has been observed to be much less than the uncatalyzed reaction of $AlCl_3$ with Mn, this realization being a distinct advantage of the instant process. Generally, reaction times of from about 2 hours to about 3 hours or less are appropriate, while concomitantly attaining yields of at least about 70% to 80% based upon the extent of Mn reacted to reduce $AlCl_3$.

The ratio of reactants can vary either way in that either the $AlCl_3$ or the Mn can be present above stoichiometric proportions. However, it is preferred when utilizing the liquid $AlCl_3$/solid Mn procedure taught herein to have the $AlCl_3$ present above stoichiometric proportions at all times so that it will serve as an absorption vehicle for removal of the $MnCl_2$ produced during the reaction, an excess of the $AlCl_3$ being continually removed from the reaction zone during operations. The $MnCl_2$ would be subsequently extracted therefrom and the $AlCl_3$ recycled to the reaction zone.

It has also been found that only relatively small amounts of the catalytic agent is required in order to achieve high conversion rates, e.g., generally no greater than 1% and quite often about 0.5% or less based upon the weight of $AlCl_3$. The various Group II B metals and compounds thereof also catalyze the reaction of $AlCl_3$ with Mn to essentially the same extent so long as a sufficient amount of the catalyst is added and a high enough reaction temperature is utilized. Generally, mercury and mercury compound can be utilized over a wide range of temperatures and at 200° C or lower. Cadmium and zinc metals and compounds thereof on the other hand give best results when utilized at about 300° C or higher.

The process of the present invention can be practiced in many forms of commercial equipment. It is amenable to many conventional solid-liquid contactors, reactors and flow arrangements such as fluid, static and moving bed reactors, batch reactors, and cyclone and tube transport reactors, all in concurrent, counter-current, semi-continuous or batch arrangements. Agitation may be performed by stirrers, flow or recirculation of slurry, vibrators, shakers, or the recycling of an inert gas or liquid $AlCl_3$, rotating or tumbling drum with or without flights, grinding balls, or other obvious means.

What we claim as our invention is:

1. A process for producing aluminum or a high content aluminum alloy comprising:

reacting aluminum chloride with manganese in the presence of a catalyst selected from the group consisting of zinc, cadmium, mercury, or compounds thereof.

2. The process of claim 1 further characterized in that:

said catalyst comprises zinc or compounds thereof.

3. The process of claim 1 further characterized in that:

said catalyst is elemental zinc.

4. The process of claim 1 further characterized in that:

said aluminum chloride is provided in excess of stoichiometric proportions required to react with manganese.

5. The process of claim 1 further characterized in that:

the aluminum chloride is present as a liquid and the manganese is present as a solid in powder form.

6. The process of claim 5 further characterized in that:

said reaction is conducted at a temperature of about 200° C sufficient to liquify said aluminum chloride up to about 350° C.

7. The process of claim 6 further characterized in that:

said reaction is conducted at a pressure no greater than about 30 atmospheres.

8. The process of claim 5 further characterized in that:

an inert salt is added to the aluminum chloride in sufficient amount to lower the melting point of aluminum chloride.

9. The process of claim 8 further characterized in that:

the reaction of liquid aluminum chloride with solid powdered manganese is carried out at a temperature below about 200° C.

10. The process of claim 5 further characterized in that:

an inert salt is added to the aluminum chloride in sufficient amount to lower the vapor pressure of aluminum chloride.

11. The process of claim 10 further characterized in that:

said reaction is carried out at a temperature in the range of from about 350° C to about 650° C.

12. The process of claim 1 further characterized in that:

the Group II B catalyst metal is separated from the high aluminum product alloy to produce an alloy comprising essentially aluminum-manganese.

13. The process of claim 12 further characterized in that:

the separated Group II B catalyst metal is recycled for further utilization.

14. The process of claim 1 further characterized in that:

the Group II B catalyst metal, unreacted manganese metal, and trace metal impurities are separated from the high aluminum product alloy to produce essentially pure aluminum metal.

15. The process of claim 14 further characterized in that:

the separated manganese metal is recycled for further reaction and utilization.

16. An improved process for the reaction of aluminum chloride with manganese wherein the improvement comprises:

conducting the reaction in the presence of a catalyst selected from the group consisting of zinc, cadmium, mercury, or compounds thereof.

* * * * *